US006753776B2

(12) United States Patent
Drinkard

(10) Patent No.: US 6,753,776 B2
(45) Date of Patent: Jun. 22, 2004

(54) PRESENCE SENSING SYSTEM AND METHOD

(75) Inventor: John Drinkard, Redwood City, CA (US)

(73) Assignee: Scientific Technologies Incorporated, Fremont, CA (US)

( * ) Notice: Subject to any disclaimer, the term of this patent is extended or adjusted under 35 U.S.C. 154(b) by 128 days.

(21) Appl. No.: 09/934,352

(22) Filed: Aug. 21, 2001

(65) Prior Publication Data

US 2002/0041231 A1 Apr. 11, 2002

Related U.S. Application Data

(60) Provisional application No. 60/227,960, filed on Aug. 25, 2000.

(51) Int. Cl.[7] ..... G08B 21/00

(52) U.S. Cl. ..... 340/540; 340/541; 340/545.3; 340/567; 340/511; 340/522; 340/578; 250/342; 250/349; 250/347

(58) Field of Search ..... 340/540, 541, 340/545.3, 567, 511, 522, 578; 250/342, 349, 347

(56) References Cited

U.S. PATENT DOCUMENTS

| | | | | | |
|---|---|---|---|---|---|
| 4,207,560 | A | * | 6/1980 | Poirier | 340/552 |
| 4,484,075 | A | | 11/1984 | Kahl, Jr. et al. | 250/432 |
| 4,523,095 | A | * | 6/1985 | Keller-Steinbach | 250/349 |
| 4,656,462 | A | * | 4/1987 | Araki et al. | 340/556 |
| 5,026,990 | A | * | 6/1991 | Marman et al. | 250/342 |
| 5,057,818 | A | | 10/1991 | Tennefoss | 340/525 |
| 5,302,942 | A | | 4/1994 | Blau | 340/556 |
| 5,486,691 | A | | 1/1996 | Dieterle | 250/221 |
| 5,499,016 | A | * | 3/1996 | Pantus | 340/555 |
| 6,115,128 | A | * | 9/2000 | Vann | 356/375 |
| 6,166,371 | A | * | 12/2000 | Milbrath et al. | 250/221 |
| 6,215,398 | B1 | | 4/2001 | Mudge et al. | 340/556 |
| 6,239,423 | B1 | * | 5/2001 | Hama et al. | 250/221 |
| 6,259,355 | B1 | * | 7/2001 | Chaco et al. | 340/286.07 |
| 2002/0041231 | A1 | | 4/2002 | Drinkard | 340/541 |

FOREIGN PATENT DOCUMENTS

| | | | |
|---|---|---|---|
| DE | 3700009 | 7/1988 | G01S/17/46 |
| GB | 2349301 | 10/2000 | G08B/21/22 |

* cited by examiner

*Primary Examiner*—Daniel J. Wu
*Assistant Examiner*—Tai T. Nguyen
(74) *Attorney, Agent, or Firm*—Coats & Bennett, P.L.L.C.

(57) ABSTRACT

A presence sensing system provides one or more visible indicators useful for indicating a relative location of objects sensed within the scanning field of view. For example, the system may have an indicator array or an integrated display assembly in which individual indicators or indicator positions correspond to defined portions of the system's field of view. In this manner, the presence sensing system can indicate where one or more sensed objects lie within its field of view. The system may monitor or otherwise scan an angular field of view and may have an indicator array comprising a plurality of individual indicators, each one corresponding to a portion of the monitored area. With this configuration, the system selectively illuminates or otherwise activates those indicators in the array corresponding to the relative angles of detected objects within its field of view.

41 Claims, 5 Drawing Sheets

PRESENCE SENSING SYSTEM AND METHOD

RELATED APPLICATIONS

The present application claims benefit of priority under 35 U.S.C. 119 from the provisional application Serial No. 60/227,960, filed on Aug. 25, 2000, and entitled "Presence Sensing Scanner Monitoring System and Method," the disclosure of which is incorporated herein by reference in its entirety.

BACKGROUND OF THE INVENTION

Object sensing systems, also referred to as presence sensing systems, find utility in a variety of applications. In some areas of use, object sensing involves distance measurement. Distance measurement may be based on, for example, measuring the flight time of an emitted laser pulse based on sensing its return reflection from an object of interest. Applications ranging from surveying to hazardous machinery guarding may make use of such radiated signal distance measuring technology.

Measuring distance based on the flight time of an emitted laser pulse entails many challenges, with the task of maintaining an accurate time-of-flight measuring system standing foremost among those challenges. Because of the small intervals of time involved, precision and repeatability are paramount in producing accurate and reliable distance measurements. In some cases, the distance measurement application requires run-time verification of distance measurement accuracy, such as is required in safety-critical machine guarding applications. Maintaining guarding operations and object sensing performance in the face of these underlying run-time verification requirements exacerbates the challenges.

In many guarding operations, object sensing requirements relate to a given sector or field of view in advance of a hazardous area or point. Thus, object sensing necessarily extends over or across this field of view. One approach to effectively covering this field of view entails stepping a distance-sensing scanner across the field of view at sufficiently small steps to meet the required object detection resolution requirements. In some implementations, a laser scanner is configured to have a rotating scanning mechanism that repeatedly takes distance measurements at discrete angular points across a given field of view or sector. Return reflections from the angular scan points are evaluated to determine if the encroachment of any detected object violates configured guarding parameters.

One difficulty associated with installing, configuring, and monitoring presence sensing systems stems from the relative inscrutability of the system regarding its operation. That is, without some type of intelligent interface to the presence sensing system, it is difficult for an observer to glean much about the typical system's operation, particularly regarding the relative position of detected objects within the system's field of view.

Ideally, where the system is configured as a relatively wide field-of view system, it should include position indicators, such as azimuthally arranged visible indicators that may be used to indicate the relative angles or directions to one or more objects detected within the system's field of view.

BRIEF SUMMARY OF THE INVENTION

The present invention comprises a method and apparatus enabling a presence sensing system to visibly indicate where detected objects lie within its field of view. This visible indication greatly aids an observer in verifying, troubleshooting, and monitoring the system's presence sensing operations.

Commonly, the system is configured to monitor a field of view in advance of a hazardous area, such as in machine guarding applications where the system monitors a physical area in advance of hazardous machinery. In this type of application, the system may be configured with an array of detection indicators, with individual ones of the indicators corresponding to particular portions of the system's field of view. Thus, by illuminating the indicator most closely corresponding to the relative angle or position of a detected object, the system provides the observer with valuable information regarding the location of a detected object within the system's field of view.

Use or activation of the detection indicators may vary depending upon the system's operating mode. In some configurations, the indicators are active only in certain modes, such as a troubleshooting or installation modes. In other configurations, the detection indicators are active during the normal course of operation. Additional variations exist regarding the arrangement of indicators, and type of indicator used. For example, the indicators may comprise an array of discrete LEDs, or may comprise an integrated LED or LCD assembly. Other indicator types, such as neon or incandescent lamps may be desirable in some configurations. Further, the indicators may be single color or may employ two or more colors, where the illuminated color, for example, might be chosen based on the detected object's distance.

DETAILED DESCRIPTION OF THE INVENTION

Figure 1:
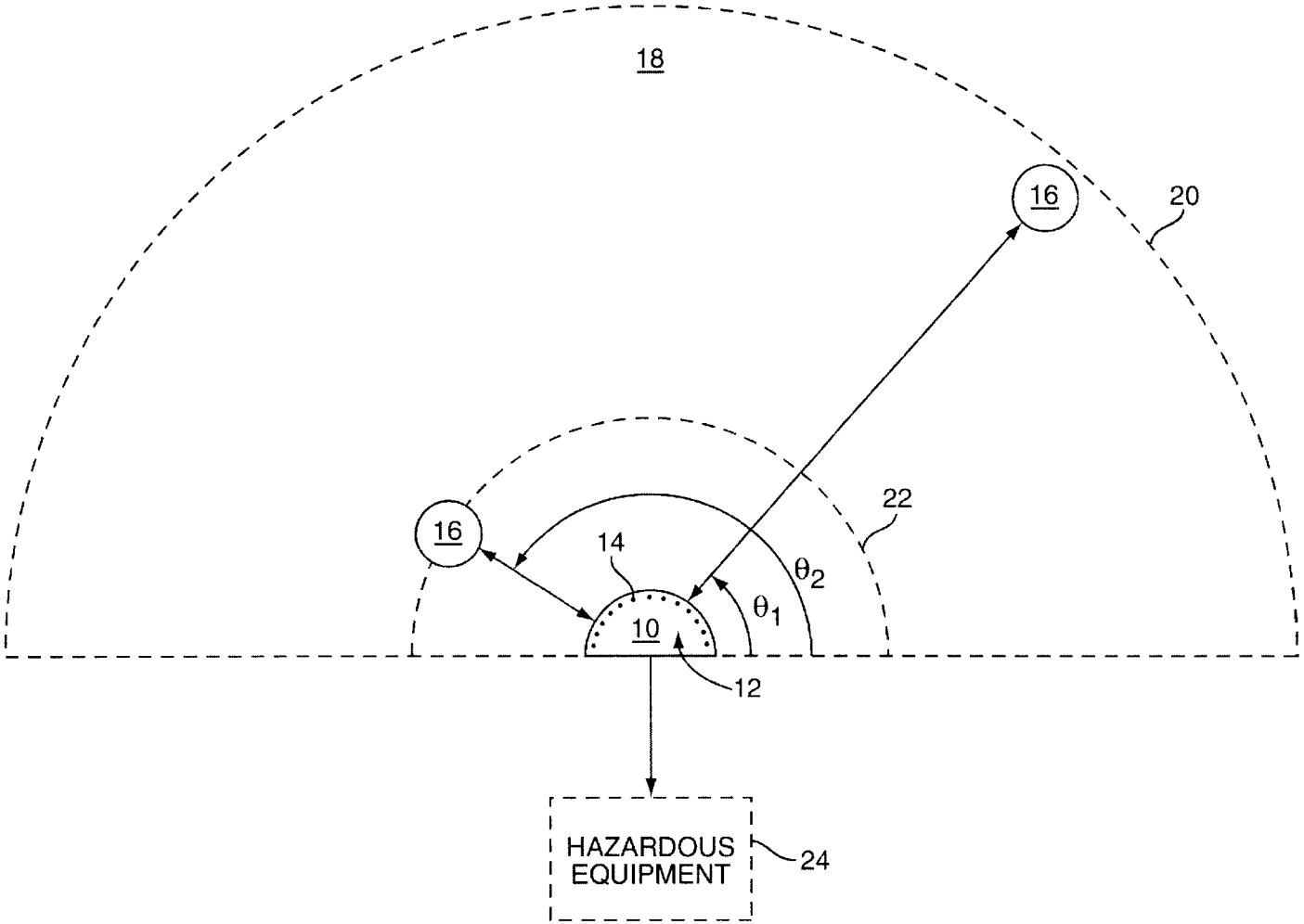
FIG. 1 is a diagram of an exemplary presence sensing system installation.

FIG. 1 is a diagram of a typical installation of a presence sensing system 10 that incorporates detection indication features in accordance with an exemplary embodiment of the present invention. More particularly, the system 10 includes one or more detection indicators, shown here as an array 12 of detection indicators 14, which are useful in indicating the relative position or angle at which an object 16 is sensed within the system's field of view 18. Detection indicators 14 may be used to visibly indicate to an observer of system 10 the relative positions of objects 16 that are detected within the field of view 18. Such indications are particularly useful to personnel charged with installing, configuring, or troubleshooting the system 10, and can provide useful information during normal operation of the system 10.

Generally, the system's operating parameters define the field of view or protected area 18. These parameters typically include a maximum detection distance, which sets an outer boundary 20 defining approximate detection distance limits of the system 10, and may include a critical detection distance defining a safety-critical detection distance 22. A critical detection distance 22 may be useful in establishing an object encroachment threshold that, when violated, causes the system 10 to shutdown or suspend operation of the equipment 24.

Typically, the system 10 is positioned in advance of hazardous equipment 24. Often, one or more industrial machines comprise the hazardous equipment 24, and the system 10 thus finds common use in machine guarding applications. Frequently, the system 10 interfaces with the equipment 24 it guards through one or more connections 13. It may be that connection 13 provide a signal output responsive to object detection functions of the system 10, or it may be that system 10 controls or gates operating power to the equipment 24, such that when system 10 detects object encroachment within the protected area 18 in violation of detection settings, power is removed from the equipment 24. In other variations, the connection 13 may comprise a network connection on which system 10 provides detection status and other operating information to remote equipment (not shown), which remote equipment may or may not be responsible for shutting down the equipment 24.

One reason that the indicators 14 are so helpful is that typical presence sensing systems provide only an indication of whether an object 16 is or is not detected within the area 18. Absent an intelligent connection to the typical presence sensing system through, for example, a laptop computer, the observer really has no reliable way of determining what object(s) 16 are encroaching in the protected area 18, and where such encroachments exist across the field of view 18.

One might consider the potential complexity of the typical manufacturing environment where equipment 24 typically finds use to appreciate that object encroachment problems are often not readily apparent from inspection of the area to be protected or monitored by the system 10. It may be that, during an initial installation of the system 10, many objects are arrayed around the field of view 18, with one or more of them encroaching just beyond allowable limits. The present invention allows the system 10 to provide convenient, useful information in this and in other scenarios.

For example, with the indicators 14, the system 10 may provide the operator with a dynamic indication of object movement across the field of view 18 by illuminating the indicators 14 in sequence as the object 16 moves across or through the field of view 18. This type of indication would allow, for example, an operator to verify object detection continuity through the field of view 18. Provided the installer used an appropriately sized test object, this type of test would be an effective and quick method of verifying detection capabilities.

In the illustration, the system 10 detects two objects 16 within its field of view 18, the first object 16 at a detection angle of $\theta_1$, and the second object 16 at a detection angle $\theta_2$. With array 12, the system 10 may illuminate or otherwise highlight the indicators 14 within the array 12 that most closely correspond to the relative angles of the two detected objects 16. In this manner, an observer of the system 10 may readily determine the relative positions of the detected objects 16 based on which indicators 14 are illuminated.

Figure 2:
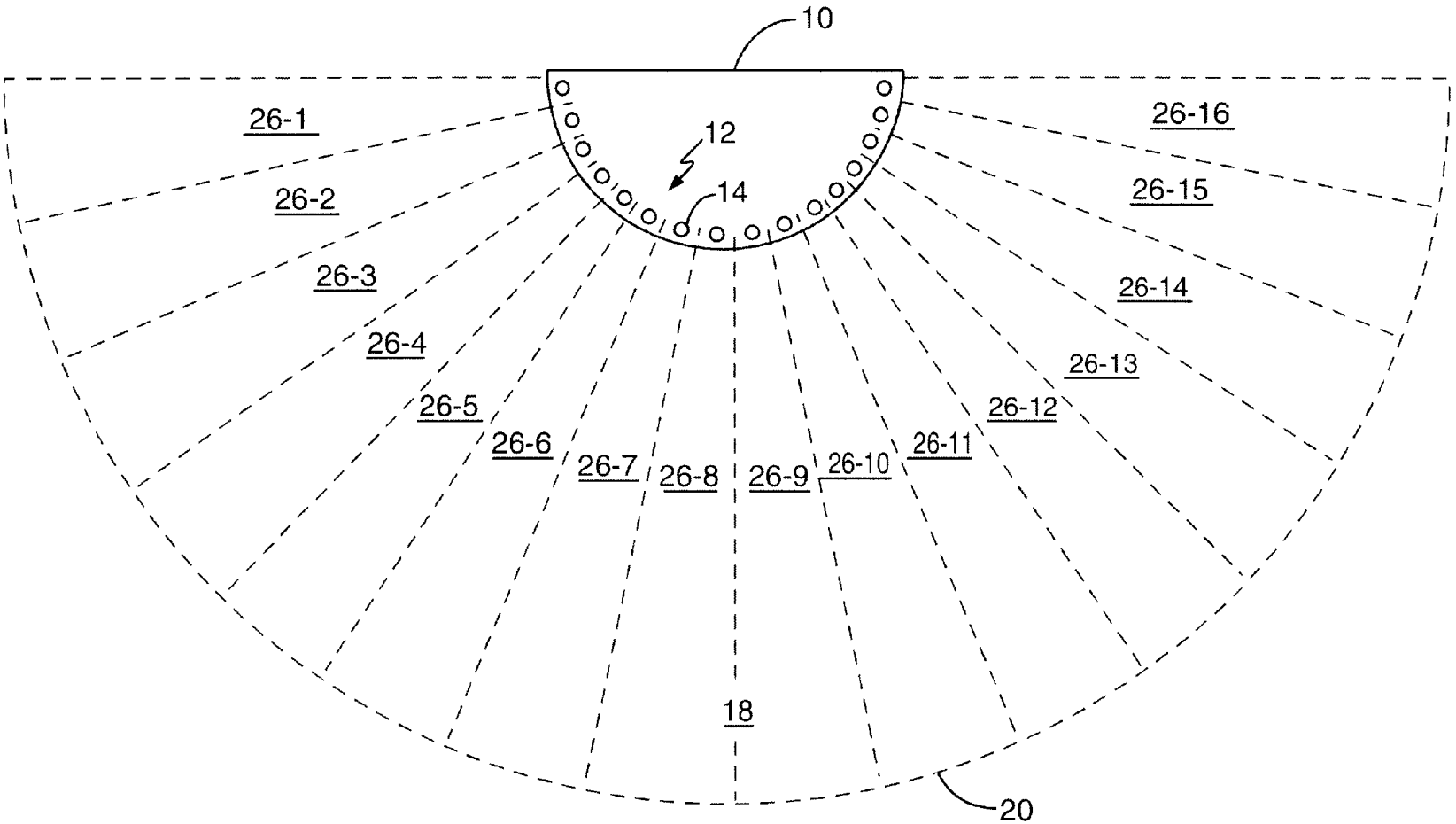
FIG. 2 is a diagram of exemplary field of view sectorization.

FIG. 2 more clearly illustrates an exemplary implementation of the present invention. The protected or monitored area 18 may be regarded as comprising a number of sectors 26. This arrangement may be thought of as "sectorizing" the field of view 18.

In this exemplary embodiment, there are sixteen sectors (26-1 through 26-16). The array 12 includes a corresponding sixteen indicators 14, wherein each indicator 14 is associated with a particular one of the defined sectors 26. Preferably, successive indicators 14 are associated with successive sectors 26. When the system 10 detects an object within a sector 26, it illuminates or otherwise activates the corresponding indicator 14. Objects large enough to span multiple sectors 26 may cause the system 10 to illuminate a corresponding group of indicators 14, which may have the added benefit of conveying relative size information to the observer. Of course, the system 10 may choose to illuminate only one indicator 14 for each object 16 it detects. One skilled in the art will recognize the many variations possible for controlling the indicators 14.

For example, the array 12 may be used to provide diagnostic information in addition to showing the angular position of interfering objects 16 within the field of view 18. Using the array 12 to provide beam diagnostic information, such as angular information corresponding to sector blockage, is particularly useful where the system 10 scans or otherwise monitors a wide-angle field of view 18. Absent angular diagnostic information as may be provided by the array 12, ascertaining where potential detection problems lie within the field 18 can be difficult.

In other diagnostic functions, the array 12 may be used as to indicate encoded information, such as encoded diagnostic or troubleshooting information. In this configuration, the detection indicators 14 within the array 12 may correspond to ordered binary digits. For example, if the array 12 comprises N indicators 14, it may be used to display N-bit diagnostic or information codes defined for the system 10.

In terms of the detection indicators 14, the array 12 may comprise an arrangement of discrete indicators 14, or may comprise an integrated assembly of indicators 14. A variety of indicator technologies may be used to implement the array 12. For example, the indicators 14 may comprise light-emitting diodes (LEDs), which may offer advantages in terms of operating power requirements, brightness, and circuit simplicity. However, essentially any other indicator technology may be used, such as incandescent or neon lamps, or liquid-crystal displays (LCDs).

In other implementations, the array 12 may not actually comprise separate indicators, but rather comprise one or more display devices adapted to provide visible indicators at desired points or positions along the display relative to the field of view 18. Thus, one or more integrated-type displays may be used to effectively mimic the operation of discrete indicators 14.

Figure 3:
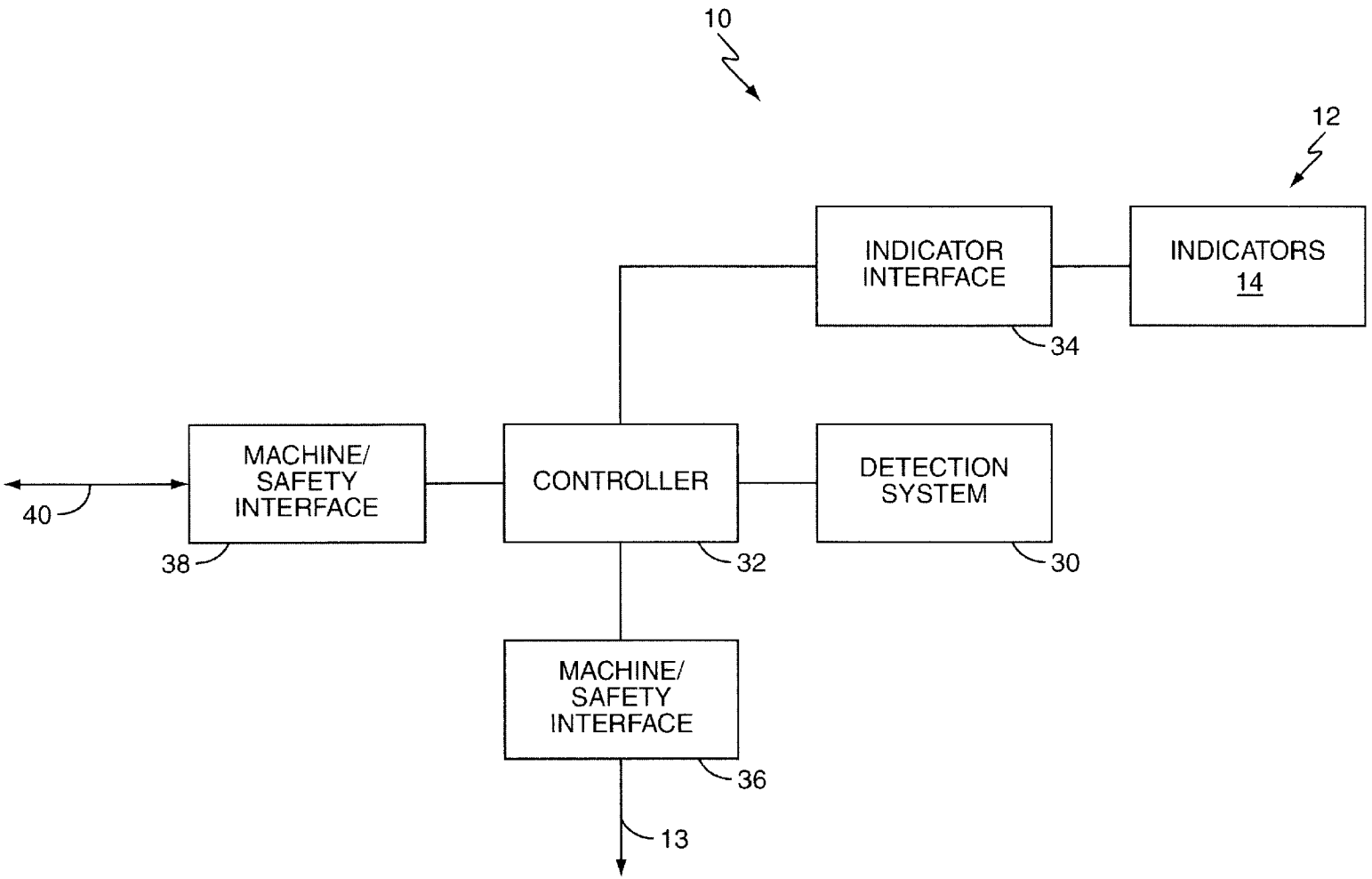
FIG. 3 is a diagram of an exemplary presence sensing system.

FIG. 3 is an exemplary diagram of system 10. System 10 comprises a detection system 30, a controller 32, an indicator interface 34, a machine/safety interface 36, and a local communication/network interface 38 supporting a data connection 40.

It should be understood that these system details are exemplary only, and that the system 10 may be implemented in a variety of other ways. For example, the controller 32 may comprise one or microprocessors and supporting circuitry, or other appropriately configured logic circuits. Where the indicators 14 are discretely implemented, the indicator interface 34 may simply comprise transistor/resistor circuits operative to set the appropriate current levels through the indicators 14 under control of the controller 32. In addition, the machine/safety interface 36 may comprise one or more safety relays positioned to make or break the operating power circuit of the equipment 24, or may comprise a data interface via connection 13 for external communication. Likewise, the local/network interface 38 may comprise a data interface, such as EIA-232, Universal Serial Bus, or other such interface.

Detection system 30 may comprise any number of presence sensing technologies or arrangements. For example, detection system 30 may comprise one or monolithic arrays of individual detector elements (e.g., CCD, MOS or CMOS type sensors) operating in conjunction with a light source (not shown), wherein the detector elements comprising detector 30 serve as object detectors based on sensing return reflections from objects 16 in the protected area 18. The emitter (not shown) directs light energy into at least a portion of the field of view 18, and the detector elements or arrays (e.g., CCDs or active pixels) sense return reflections.

In this array-based configuration, the detection system 30 represents a static "staring beam" type system. With a CCD-based detector 30, the particular CCD or CCDs within an CCD array that receive reflected energy depends upon the position of the reflecting object 16 within the protected area 18, and thus may be used by the controller 32 to determine which one (or ones) of the indicators 14 to illuminate.

Many other alternatives exist regarding implementation of the system 10, particularly with regard to the detection system 30. For example, FIGS. 4 and 5 illustrate exemplary details for a scanning laser-based system 10.

Figure 4:
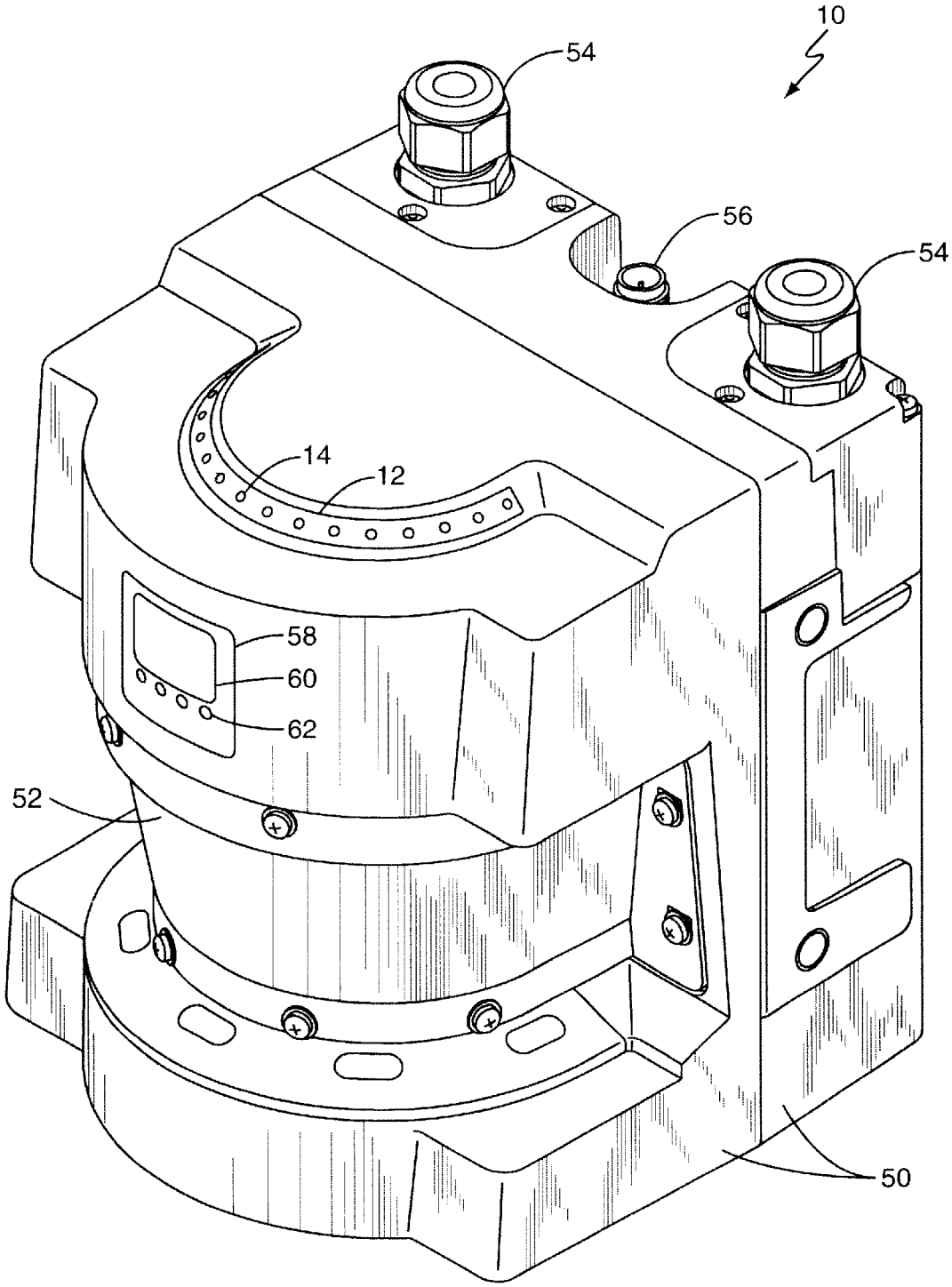
FIG. 4 is a diagram of an exemplary scanning laser presence sensing system.
Figure 5:
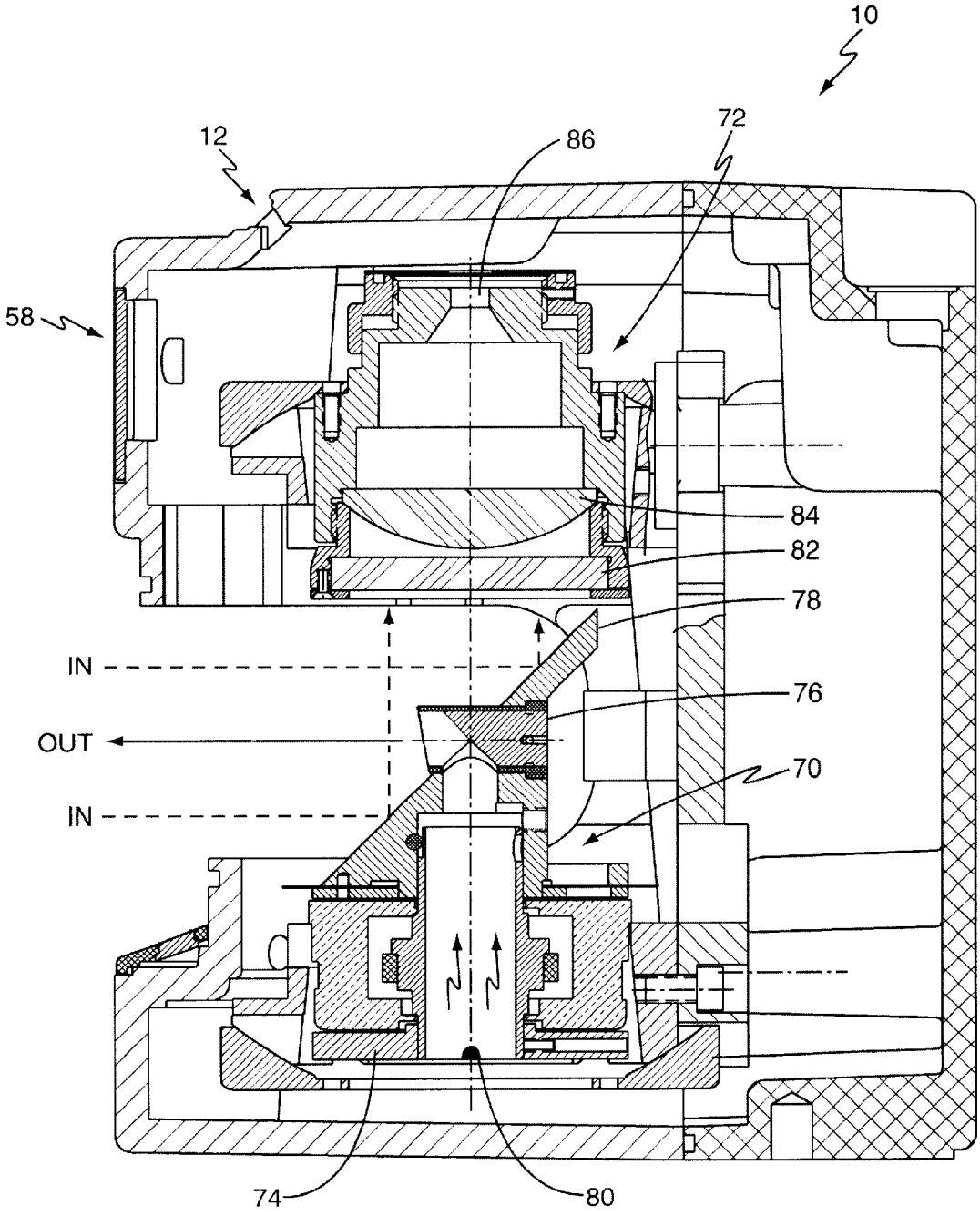
FIG. 5 is a diagram of a scanning and detection assemblies for use in the scanning laser system of FIG. 4.

FIG. 4 is a diagram of an exemplary implementation of the system 10 and illustrates an advantageous positioning of the array 12. In this embodiment, the system 10 comprises a housing or enclosure 50, which may be implemented as a combination of two or more assembled pieces, a scanning window 52, mounting posts 54, a system interface 56 (which may be connection 40), and an integrated status display 58, which may comprise a diagnostic indicator 60 and discrete status indicators 62.

The system 10 emits laser pulses through its scanning window 52, and has the ability to step or sweep these pulses across the field of view 18. FIG. 5 illustrates exemplary details supporting scanning and detection operations of the system 10. The detection system 30 comprises a scanning assembly 70 and a detection assembly 72. The scanning assembly 70 generates a detection signal, here a pulsed laser beam, and receives return reflections of the detection signal, which it directs into the detection assembly 72.

The scanning assembly 70 comprises a hollow-shaft motor 74 on which rotates transmit and receive mirror assemblies 76 and 78, respectively. A laser transmitter 80, such as a laser diode, emits laser light upward through the hollow shaft of the motor 74, which light impinges on the transmit mirror 76, where it is directed outwards into the field of view 18. The instantaneous angle of rotation of the scanning assembly 70 determines the angular direction of the emitted laser pulse into the field of view 18. Thus, by rotating the scanning assembly 70, the detection signal is swept across the field of view 18.

The detection assembly 72 comprises lenses 82 and 84, which receive and preferably collimate reflected laser light directed by the receive mirror 78 into them. A detector 86, such as an avalanche diode and supporting circuitry, serves to detect the return reflections from objects 16 within the system's field of view 18. Typically, the system 10 further comprises supporting circuitry not shown in the interest of simplicity. For example, the system 10 may comprise one or more circuit boards (not shown) carrying analog and digital circuits for generating and controlling the laser transmitter 80, and receiving and processing return reflection signals from the detector 86.

Detection of an object 16 within the field of view 18 entails, in a simplified presentation, timing the total flight time of an emitted laser pulse and its return reflection. Thus, if the total flight time is Δt, the distance may be roughly calculated as $$\frac{1}{2}\cdot\Delta t\cdot S,$$

where S is the speed of light, which may be expressed in meters/second, and where the "½" term accounts for the actual distance being determined based on one half the total travel time Δt. Of course, the system 10 may apply more sophisticated processing to its distance measurements as it scans through the field of view 18.

In FIG. 4, it may be seen that the detection indicators 14 are preferably arrayed along an arc that roughly matches the scanning sector comprising the field of view 18, and are preferably mounted to enhance their visibility. This might entail, for example, positioning the array 12 on an angled face of the enclosure 50, such that the indicators 14 take on a favorable viewing angle relative to an observer positioned within the field of view 18. Thus, the indicators 14 may be configured as an azimuthal array of beam or detection angle indicators. In general, the array 12 may be arranged to match the physical characteristics of the field of view 18 and thus may not always be arranged in a sector arc.

The status display 58 is also preferably positioned such that it may be viewed simultaneously with the array 12. By adopting complementary positioning of the status display and the array 12, the two may be used in concert during installation or diagnostic operations. For example, the status display 58 may be used to display mode or debugging information, while the array 12 provides angular information regarding the detection operation being verified. Alternatively, as mentioned above, the array 12 may provide encoded diagnostic information, such as binary-encoded troubleshooting codes, with or without benefit of coordinated information on the status display 58.

In other variations of indicator operation, it should be noted that each indicator 14 might actually comprise two or more elements capable of generating different colors. In such configurations, the illuminated color of the indicators 14 may be a function of object distance. For example, a corresponding indicator 14 in the array 12 may have a first color where an object 16 is outside the critical distance threshold 22 and a second color when the object 16 violates the critical distance threshold 22. Of course, color-coding may have utility in other diagnostic uses of the indicators 14. Other variations might include blinking the indicators 14 as a function of object distance or desired diagnostic information.

It should be understood that the discussion above is exemplary and should not be construed as limiting the present invention. In general, the present invention comprises one or more indicators 14 for providing position information, such as detection angle, relative to detected objects 16 within the presence sensing system's field of view 18. Further, the implementation and operation of the indicators 14 is the subject of much variation. For example, the indicators 14 may operate differently in different operating modes of the system 10, and may be used to provide other information besides object detection information. Thus, the indicators 14, for example, might be used to provide encoded diagnostic information. Therefore, the present invention is not limited by the foregoing discussion, and is limited only by the scope of the following claims and their reasonable equivalents.

What is claimed is:

1. A presence sensing system for monitoring a protected area in machine guarding applications, said presence sensing system comprising:

a detection system including a light emitting circuit to direct light into the protected area and a detection circuit to detect relative directions and distances to objects in the protected area by sensing return reflections of the directed light; and one or more indicators to visibly indicate the relative directions of objects detected within the protected area based on a return direction of the return reflections.

2. The presence sensing system of claim 1 wherein said one or more indicators comprise an array of indicators.

3. The presence sensing system of claim 2 wherein each indicator in said array of indicators is associated with a sector of said protected area, such that said indicator is activated in response to an object being detected in the associated sector.

4. The presence sensing system of claim 2 wherein said array of indicators functions as a detection angle indicator by indicating detection angles of objects detected within the protected area.

5. The presence sensing system of claim 2 wherein said array of indicators comprises one or more displays, and wherein individual indicators in said array comprise selectively activated regions of said one or more displays.

6. The presence sensing system of claim 2 wherein said array of indicators comprises a plurality of discrete indicators.

7. The presence sensing system of claim 6 wherein each said discrete indicator comprises an LED.

8. The presence sensing system of claim 2 wherein said array of indicators comprises an arrangement of indicators corresponding to a sectorized layout of the protection area.

9. The presence sensing system of claim 8 wherein said arrangement of indicators comprises an arced array of indicators.

10. The presence sensing system of claim 1 further comprising a controller to selectively activate said one or more indicators in dependence on the return directions of one or more return reflections from objects in said protected area.

11. The presence sensing system of claim 10 wherein said controller selectively activates said one or more indicators based on associating given indicators with given sectors in the protected area.

12. The presence sensing system of claim 1 further comprising a machine interface to assert an output signal responsive to detecting one or more objects in the protected area.

13. The presence sensing system of claim 1 wherein said detection circuit comprises an array-based detection circuit.

14. The presence sensing system of claim 13 wherein said array-based detection circuit comprises an array of detection circuits.

15. The presence sensing system of claim 1 wherein said light emitting circuit comprises:

a scanning laser to sweep a laser beam through the protected area; and wherein said detection circuit is responsive to return reflections of the laser beam.

16. The presence sensing system of claim 15 wherein said one or more indicators function as beam angle indicators operative to indicate relative angles at which said presence sensing system detects objects within the protected area.

17. The presence sensing system of claim 1 wherein said detection system monitors a field of view, and wherein said field of view comprises at least a portion of the protected area.

18. The presence sensing system of claim 17 wherein said field of view comprises a plurality of sectors and said one or more indicators comprises a plurality of indicators configured in an array corresponding to said sectors.

19. The presence sensing system of claim 18 wherein individual ones of said plurality of indicators correspond to specific portions of said field of view, and wherein said presence sensing system activates one or more said indicators based on the sectors in which an object is detected in the field of view.

20. The presence sensing system of claim 1 wherein said one or more indicators function as diagnostic indicators operative to indicate encoded diagnostic information to an operator of said presence sensing system.

21. The presence sensing system of claim 20 wherein said one or more indicators function as said diagnostic indicators based on indicating binary values representing encoded diagnostic information.

22. The presence sensing system of claim 1 wherein said presence sensing system controls said one or more indicators based on distances of objects detected within the protected area.

23. A machine guarding system for detecting and locating objects within a protected area of a machine, comprising:

a signal generator for generating a signal, directing the signal through at least a portion of the protected area, and detecting a relative distance and detection angle of an object within the protected area, said signal generator including a scanning laser that sweeps a laser beam through at least a portion of the protected area; and a series of indicators for indicating the relative detection angle of an object detected by the signal generator within the protected area.

24. The machine guarding system of claim 23 wherein the protected area comprises a plurality of angular sectors and said scanning laser sweeps the laser beam across the sectors, and wherein individual ones of said series of indicators correspond to designated ones of the sectors, such that said machine guarding system activates one or more of said series of indicators depending on in which sectors objects are detected.

25. A machine guarding presence sensing system comprising:

a detection system operative to detect a presence of one or more objects within a field of view of said machine guarding presence sensing system, said detection system including a light emitting circuit to direct light into the field of view and a light detection circuit to detect relative directions and distances to objects in the field of view based on sensing return reflections of the directed light;

a plurality of indicators to visibly indicate the relative direction of an object detected within the field of view; and a controller to associate individual ones of said indicators with corresponding sectors of the field of view, and to activate selected ones of said indicators in dependence on the sectors in which return reflections are received by the light detection circuit.

26. The machine guarding presence sensing system of claim 25 wherein said plurality of indicators comprise an array of discrete indicators.

27. The machine guarding presence sensing system of claim 26 wherein said array of discrete indicators comprises an arrangement of individual indicators having an arrangement corresponding to said associated sectors comprising the field of view.

28. The machine guarding presence sensing system of claim 25 wherein said plurality of indicators comprises at least one visible display having a plurality of indicator positions that may be selectively activated by said controller.

29. The machine guarding presence sensing system of claim 25 wherein said plurality of indicators comprises an array of indicators, each said indicator corresponding to an associated sector of said field of view, such that said array of indicators functions as a detection angle indicator, and wherein said machine guarding presence sensing system indicates a relative position of objects detected in the field of view based on indicating detection angles to the objects via said detection angle indicator.

30. A method of providing directional information for objects detected within a field of view of a machine guarding presence sensing system having a plurality of detection indicators, the method comprising:

directing light at known angles relative to the machine guarding presence sensing system into the field of view;

determining a relative return angle and distance for return reflections of the directed light from an object within the field of view; and activating one or more of said detection indicators to indicate the relative return angle of the return reflections.

31. The method of claim 30 wherein said field of view comprises a plurality of sectors, end further comprising associating successive ones of said detection indicators with successive ones of said sectors.

32. The method of claim 30 further comprising indicating system information via said detection indicators by activating said detection indicators in coded patterns corresponding to defined system information codes.

33. The method of claim 30 further comprising controlling activation of said detection indicators based on a distance to a detected object.

34. The method of claim 30 further comprising controlling activation of said detection indicators based on a current operating mode of said machine guarding presence sensing system.

35. The method of claim 34 wherein controlling activation of said detection indicators based on a current operating mode of said system comprises activating one or more ones of said detection indicators in response to objects being detected within said field of view during at least one mode of said machine guarding presence sensing system.

36. A method of indicating relative detection angles between a machine guarding presence sensing system having an array of detection angle indicators and an object detected in a field of view monitored by said machine guarding presence sensing system, the method comprising:

directing light into the field of view and sensing return reflections from objects within the field of view to detect relative detection angles and distances;

associating successive ones of said detection angle indicators with successive angular sectors comprising the field of view; and activating one or more of the detection angle indictors based on determining a return angle of the return reflections such that said detection angle indicators indicate the relative detection angles to objects detected within the field of view.

37. The method of claim 36 wherein directing light into the field of view comprises sweeping a laser beam through said angular sectors comprising the field of view.

38. The method of claim 37 wherein sweeping a laser beam through said angular sectors and detecting return reflections from objects within said sectors comprises:

emitting laser beam pulses at defined angular steps, said steps dividing each one of said angular sectors into discrete detection points; and wherein sensing return reflections from objects within the field of view comprises detecting return reflections of the laser beam at each said angular step.

39. The method of claim 38 wherein associating successive ones of said detection angle indicators with successive angular sectors comprising the field of view comprises assigning a given one of said detection angle indicators to a given range of said angular steps, such that one or more discrete detection angles correspond to each one of said detection angle indicators.

40. The method of claim 36 further comprising physically arranging said detection angle indicators along a curved path.

41. The method of claim 40 further comprising defining said curved path such that said array corresponds to an included angle of the field of view.

* * * * *